US008303134B2

(12) United States Patent
Byrne

(10) Patent No.: US 8,303,134 B2
(45) Date of Patent: Nov. 6, 2012

(54) FLUSH MOUNT MIRROR LIGHT

(76) Inventor: Norman R. Byrne, Ada, MI (US)

( * ) Notice: Subject to any disclaimer, the term of this patent is extended or adjusted under 35 U.S.C. 154(b) by 0 days.

(21) Appl. No.: 12/836,057

(22) Filed: Jul. 14, 2010

(65) Prior Publication Data

US 2012/0014097 A1 Jan. 19, 2012

(51) Int. Cl.
*F21V 17/02* (2006.01)

(52) U.S. Cl. ..... 362/282; 362/18; 362/125; 362/142; 362/322

(58) Field of Classification Search ..... 362/18, 362/125, 142, 144, 282, 283, 322, 410, 41, 362/108, 127, 147, 285, 287, 326–328, 414, 362/418, 427, 431
See application file for complete search history.

(56) References Cited

U.S. PATENT DOCUMENTS 1,476,149 A * 12/1923 Cohen ..... 362/282
3,671,735 A * 6/1972 King ..... 362/307
4,337,506 A * 6/1982 Terada ..... 362/142
4,388,678 A * 6/1983 Turner ..... 362/293
4,541,663 A * 9/1985 Schwanitz et al. ..... 296/97.5
4,612,604 A * 9/1986 Schlyter ..... 362/19
4,910,650 A * 3/1990 Goralnik ..... 362/147
4,994,946 A * 2/1991 NakaMats ..... 362/282
5,727,875 A * 3/1998 Huang ..... 362/414
6,533,431 B2 * 3/2003 Leifer et al. ..... 362/109
6,634,763 B1 * 10/2003 Leifer et al. ..... 362/109
6,767,107 B1 * 7/2004 Leifer et al. ..... 362/33
7,670,032 B2 * 3/2010 Lau ..... 362/322
2002/0041499 A1 * 4/2002 Pederson ..... 362/545
2011/0019391 A1 * 1/2011 Welter ..... 362/142

* cited by examiner

*Primary Examiner* — Hargobind S Sawhney

(74) *Attorney, Agent, or Firm* — Varnum, Riddering, Schmidt & Howlett LLP

(57) ABSTRACT

A flush mount mirror assembly (100) has a housing (102), a mirror assembly (110) and a light array (116). The mirror assembly (110) includes a mirror (114) coupled to a telescoping tube pair (124). The mirror (114) reflects light and is adjustable to various angular orientations.

12 Claims, 5 Drawing Sheets

FLUSH MOUNT MIRROR LIGHT

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The invention relates to light assemblies and, more particularly, a light assembly which can be extended and retracted from a housing receivable within a work surface or the like.

2. Background Art

It is known to utilize various types of light assemblies for desk surfaces and the like. It would be advantageous to have a light assembly which could be retracted into a work surface or housing within the work surface, when not in use. Also, it would be advantageous to have a light assembly which is in an overhead position when extended, and which can be at least partially manipulated so as to provide light focused at different locations.

BRIEF DESCRIPTION OF THE DRAWINGS

The invention will be described with respect to the drawings in which:

FIG. 4 is a perspective view of the flush mount mirror light shown in FIG. 2, and showing the mirror in a still different orientation, with a different surface illumination resulting there from;

DETAILED DESCRIPTION OF THE INVENTION

The principles of the invention will now be disclosed, by way of example, in a flush mount mirror light assembly 100 as illustrated in FIGS. 1-15. For purposes of brevity and clarification, the flush mount mirror light assembly 100 will also be referred to herein by alternative terms, such as "mirror light assembly" and "light assembly." The flush mount mirror light assembly 100 provides for the capability of having a compact and retractable light which may be utilized on a desk or other type of work surface. Advantageously, when in the retracted position, the light assembly 100 can be made substantially flush with the work surface. Further, and in accordance with certain aspects of the invention, the light assembly 100 is extendable to various heights above the work surface, as desired by a user. Still further, the light assembly 100 has the capability of not only adjusting the height of a mirror, but also adjusting an angular orientation of the mirror. By adjustment of the angular orientation, the positioning of an illuminated surface area, as well as the size of the illuminated surface, can correspondingly be adjusted.

Figure 1:
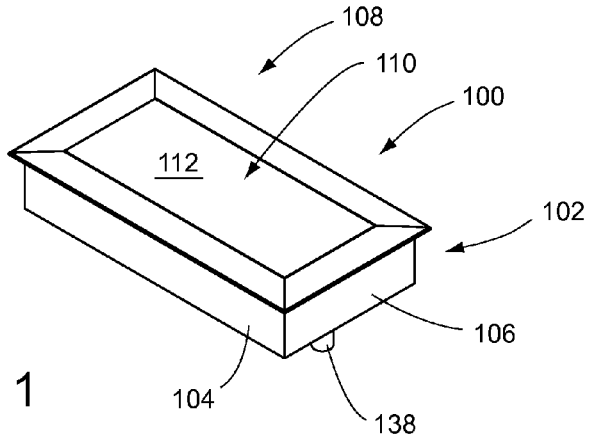
FIG. 1 is a right-side perspective view of a flush mount mirror light assembly in accordance with the invention.
Figure 2:
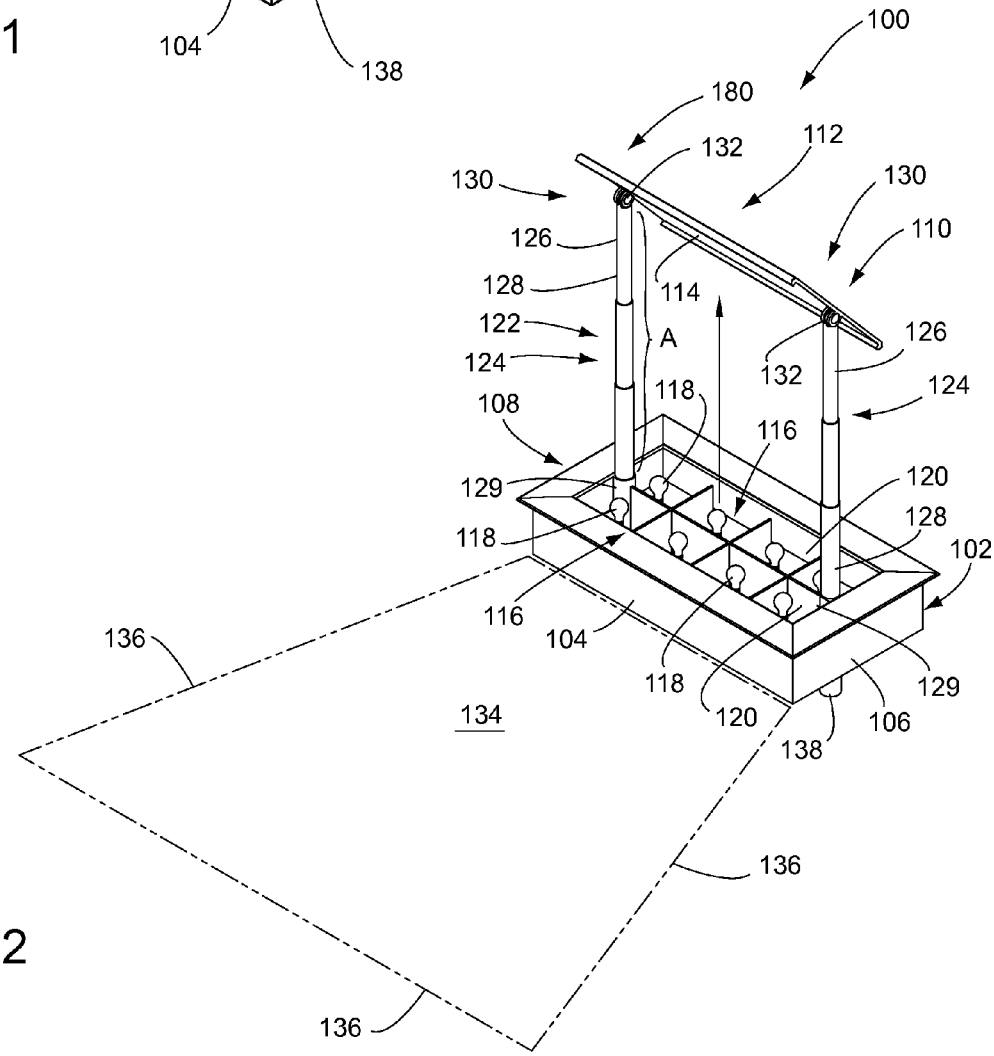
FIG. 2 is a perspective view, showing the entirety of the embodiment of the flush mount mirror light assembly in accordance with the invention, and further showing a surface area which can be illuminated when the mirror is at a particular, predetermined orientation.

Turning to the drawings, and first with respect to FIGS. 1 and 2, these drawings illustrate a flush mount mirror light assembly 100 in accordance with the invention. The light assembly 100 includes a rectangular housing 102 which is adapted to be received within a cut out or recessed portion of a desk or work surface, such as the work surface 148 in FIGS. 5-15. The housing 102 includes a pair of vertically disposed and opposing housing sides 104, as well as a pair of vertically disposed and opposed housing ends 106. A grommet 108 is positioned above the top surface of the housing 102, and can be connected to or otherwise integral with the housing 102.

With respect to the light assembly 100, the assembly 100 includes a mirror assembly 110. In FIG. 1, the mirror assembly 110 is shown in a retracted and fully closed position. In FIG. 2, the mirror assembly 110 is shown in an extended and active position. The mirror assembly 110 includes a mirror cover 112 having a planar surface and forming the enclosing cover when the light assembly 100 is in the retracted position. Attached in any suitable manner to the mirror cover 112 (or even forming an integral portion of the mirror cover 112) is a planar mirror 114 which essentially faces in a downward direction when in the retracted position (FIG. 1) and can be positioned in a downward or angled position when in the extended position (FIG. 2).

In addition to the mirror assembly 110, the flush mount mirror light assembly 100 includes a light array 116 shown primarily in FIGS. 2-7. With reference first to FIG. 2, the light array 116 includes a series of lights 118. The lights 118 can be any suitable type of illumination element which will provide sufficient illumination so as to provide a sufficiently illuminated area on the desk top or work surface, notwithstanding the light from the lights 118 will be directionally reflected off of the mirror 114. As an example embodiment, the lights 118 of the light array 116 can be individually arranged within light compartments 120, as again shown in FIGS. 2, 3 and 4. However, the light compartments 120 and particular configuration of the light array 116 can be varied in numerous ways, without departing from the spirit and scope of the novel concepts of the invention.

In addition to the light array 116, the flush mount mirror light assembly 100 also includes a mirror height adjustment system 122. The mirror height adjustment system 122 is essentially shown in all of the drawings, with the exception of FIG. 1. With reference first to FIG. 2, the mirror height adjustment system 122 can include a telescoping tube pair 124. The telescoping tube pair 124 can include two individual telescoping tubes 126 having an elongated configuration and adapted to be vertically extended from the housing 102. Each of the telescoping tubes 126 can include individual telescoping sections 128. In the particular configuration shown in FIG. 2, each telescoping tube 126 includes a set of three telescoping sections 128, along with a lower, stationary base section 129. The telescoping tubes 126 can be relatively conventional in design, and the general concept of providing for telescoping tubes having telescoping sections 128 which can maintain a stationary position, absent the application of external forces, is well known in the art. That is, the telescoping tubes 126 are preferably constructed so that a user can exert relatively minimal forces upwardly to extend the telescoping tube pair 124 to any desired height. When the upwardly directed external forces are removed, the telescoping tubes 126 maintain their then current positions, absent any other external forces applied to the same. These upwardly directed forces can be made by a user grasping either the telescoping tubes 126 themselves or, alternatively, grasping portions of the mirror assembly 110 and exerting upwardly directed forces. When it is desired to retract the mirror assembly 100, downwardly directed forces can be exerted either on the tubes 126 themselves or, alternatively, on the mirror assembly 110. Again, it should be emphasized that it is preferable for the telescoping tubes 126 to be constructed in a manner so that they will maintain a position to which they have been extended along a continuum of positions, absent the application of external forces.

In addition to the foregoing components, the flush mount mirror light assembly 100 also includes a hinge system 130. The purpose for the hinge system 130 is to provide for manual rotation or pivot of the mirror assembly 110 by a user, so as to adjust the angle of the mirror 114 relative to the light array 116 and the desk top or work surface. Specifically, and in accordance with one embodiment of a hinge system 130 which can be utilized in accordance with the invention, the hinge system 130 includes a pair of rotational hinges 132 (FIGS. 2-15), located at the top portions of the telescoping tubes 126 and also located at opposing sides of the mirror assembly 110. The hinge system 130 and rotational hinges 132 form the coupling or pivot points between the telescoping tubes 126 and the mirror assembly 110.

More specifically, each of the rotational hinges 132 can include a pair of lug set pairs 131. The lug set pairs are fixedly mounted to the sides of the mirror assembly 110 adjacent the face of the mirror 114. Correspondingly, fixedly mounted to the uppermost telescoping sections 128 of the telescoping tubes 126 are a pair of laterally extending nubs 133 (see FIG. 4). The nubs are sized and configured so as to extend through apertures 135 of each lug of the lug set pairs 131. The lugs of the lug set pairs 131, the apertures 135 and the laterally extending nubs 133 are sized and configured so that they provide for the capability of angular rotation of the mirror assembly 110 relative to the telescoping tube pair 124 through the exertion of relatively minimal manual forces applied to the mirror assembly 110. Further, the sizing and configuration of the lug set pairs 131, nubs 133 and apertures 135 is such that when the mirror assembly 110 is set at a particular angle by the user, the mirror assembly 110 will maintain that angular configuration, absent the application of additional manual forces.

In accordance with all of the foregoing, the mirror assembly 110 can be retracted by the user to the fully retracted position shown in FIG. 1, by the user exerting downwardly directing forces on the mirror assembly 110 or the telescoping tube pair 124. To raise or extend upwardly the mirror assembly 110, the user can grasp the mirror assembly 110 (through a thumb hole, hooks or other suitable means (not shown)) and raise the mirror assembly 110 thereafter by grasping the mirror assembly 110 itself, or the telescoping tubes 126 themselves. The telescoping tubes 126 will operate through their telescoping sections 128 so as to raise the mirror assembly 110 upwardly. When manually applied forces are removed, the telescoping tubes 126 will maintain their then current positions, with the mirror assembly 110 thereby maintaining its then current height. The user can then rotate the mirror assembly 110 relative to the telescoping tubes 126 through the rotational hinges 132. The angular rotation can occur until the mirror assembly 110 reaches the angular orientation desired by the user. When the user removes the manually applied forces, the then current angular rotation will then be maintained, until such time as additional external forces are applied.

As earlier stated, the height of the mirror assembly 110, and the angular orientation of the same, will determine the particular position of a surface area illuminated by the light reflected by the mirror 114. Also, the height and angular rotation of the mirror 114 will determine the size of the illuminated surface area. The following paragraphs describe surface areas illuminated by the light assembly 100 when the telescoping tubes 126 are at various heights, and the mirror 114 is at various angular rotations.

Figure 3:
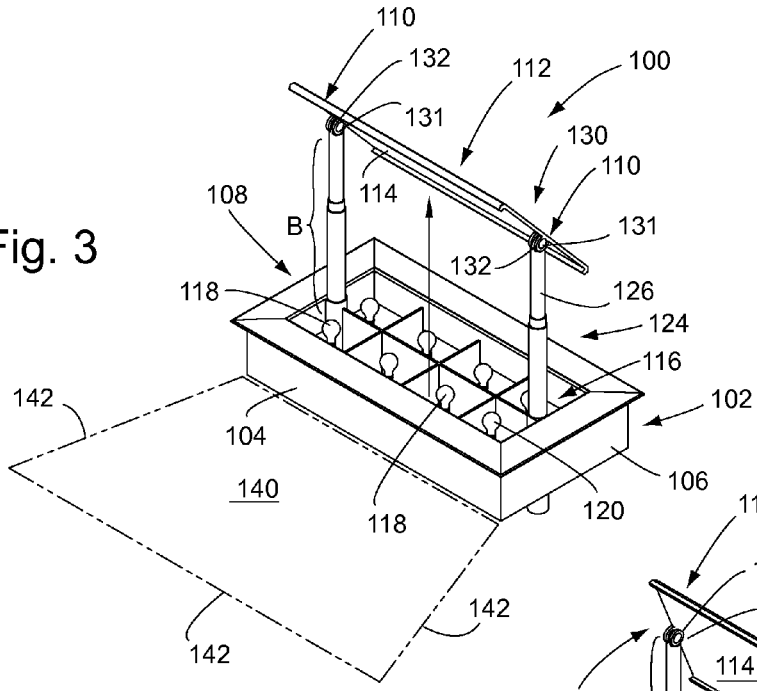
FIG. 3 is a perspective view of the flush mount mirror light shown in FIG. 2, and showing the mirror in a differing orientation, with a differing surface illumination.

As shown in FIG. 2, the mirror assembly 110 is at what might be characterized as a maximum height. That is, the telescoping sections 128 of the telescoping tubes 126 have been extended as far as mechanically possible. This height is shown in FIG. 2 as height A. With this height, and with the angular orientation of the mirror 114 as shown in FIG. 2, an illuminated surface area 134 is provided by the light from the light array 116 as reflected by the mirror 114. The illuminated surface 134 consists of the circumscribed illuminated area 136. However, it should be emphasized that the circumscribed illuminated area 136 is an approximate area and light at the edges of the area 136 will gradually "fade" as provided by the reflected light from the light array 116. FIG. 3 illustrates the light assembly 100 with the telescoping tubes 126 positioned at a shorter length or height then shown in FIG. 2. The height of the mirror assembly 110 in FIG. 3 is illustrated as height B, which is smaller than height A shown in FIG. 2. The angular orientation of the mirror 114 in FIG. 3 is substantially the same as the angular orientation of the mirror 110 shown in FIG. 2. In FIG. 3, the surface illuminated by the reflected light from the light array 116 is illustrated as illuminated surface 140. The area of the illuminated surface 140 is illustrated as circumscribed illuminated area 142. In view of the height B being less than height A, the circumscribed illuminated area 142 is smaller than the circumscribed illuminated area 136 shown in FIG. 2.

Figure 4:
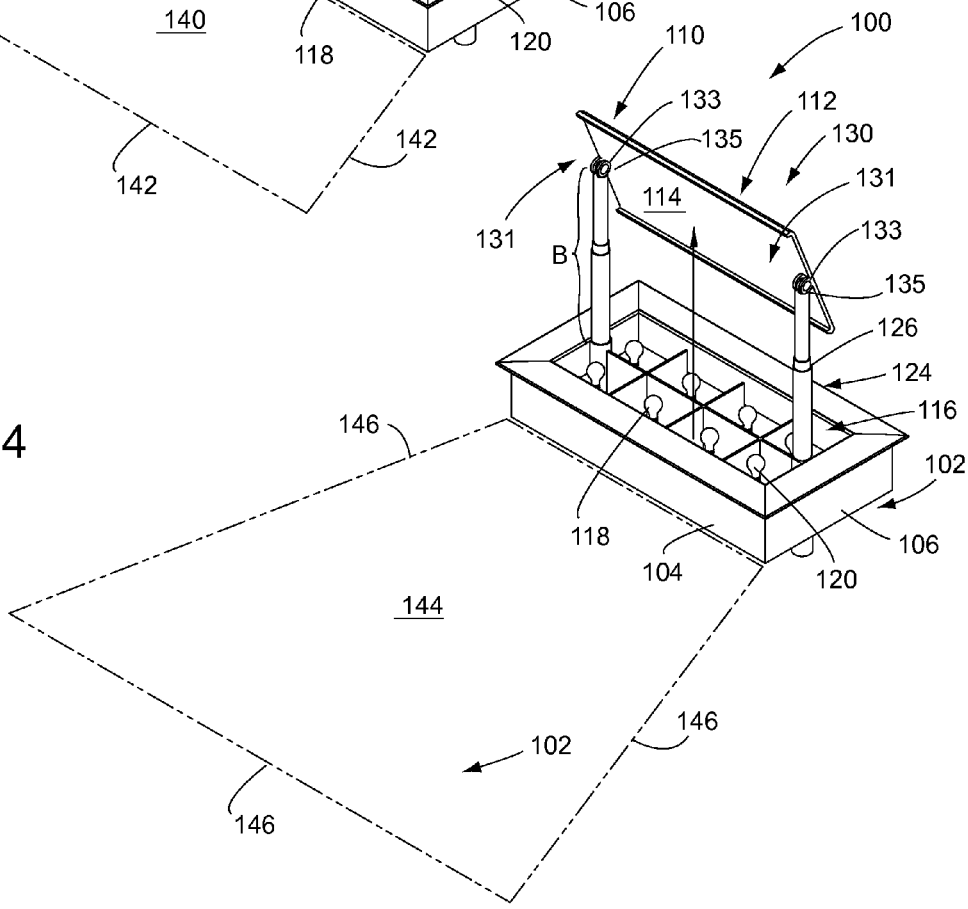

With reference to FIG. 4, the height or length of the telescoping tubes 126 is again shown as height B, similar to FIG. 3. However, as also shown in FIG. 4, the mirror 114 is at a relatively greater angle relative to a horizontal plane of the surface area to be illuminated. The illuminated surface is illustrated in FIG. 4 as surface 144, consisting of circumscribed surface area 146. In view of the greater angle of the mirror 114 relative to the angle shown in FIG. 3, the size of the circumscribed surface area 146 is greater than the circumscribed area 142 of FIG. 3.

Figure 5:
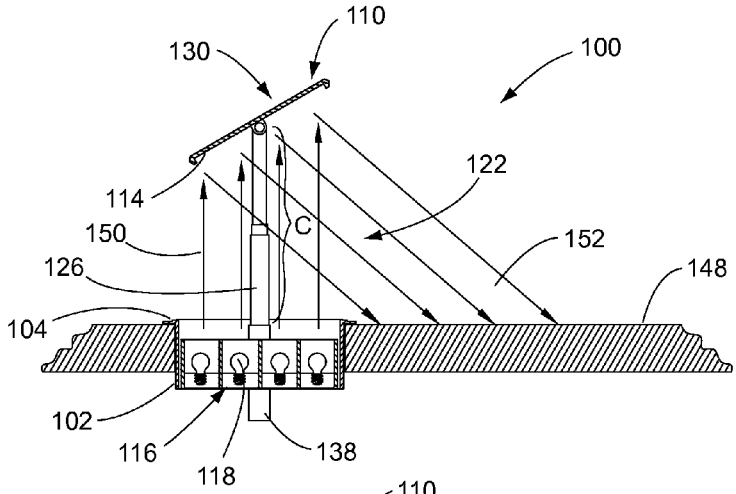
FIG. 5 is a side, sectional view of the flush mount mirror light, and showing the mirror in an orientation substantially corresponding to the orientation shown in FIG. 3.
Figure 6:
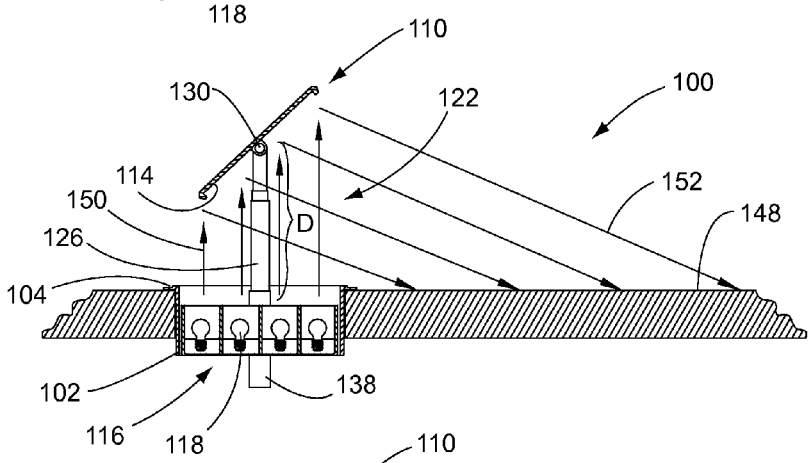
FIG. 6 is a side, sectional view of the flush mount mirror light, similar to FIG. 5 but showing the mirror in an orientation substantially corresponding to FIG. 4.

FIG. 5 is a side, sectional view of the light assembly 100, showing the telescoping tubes at a height C and the mirror 114 at a particular angular orientation. For purposes of the description and understanding, FIG. 5 illustrates the light rays generated from the lights 118 as traveling upwardly toward the mirror 114. These generated light rays are shown as light rays 150. In response to these light rays 150, the mirror 114 causes a set of reflected light rays 152 to be generated. These reflected light rays 152 impinge on the desk top or work surface 148. FIG. 6 is similar to FIG. 5, but illustrates the height of the telescoping tubes 126 to be a height D, which is less than height C. However, the angular orientation of the mirror 114, relative to a horizontal plane, is greater than the angular orientation of the mirror 114 shown in FIG. 5. Accordingly, the light rays 152 extend a greater distance away from the light assembly 100 in the embodiment of FIG. 6, compared to the embodiment of FIG. 5.

Figure 7:
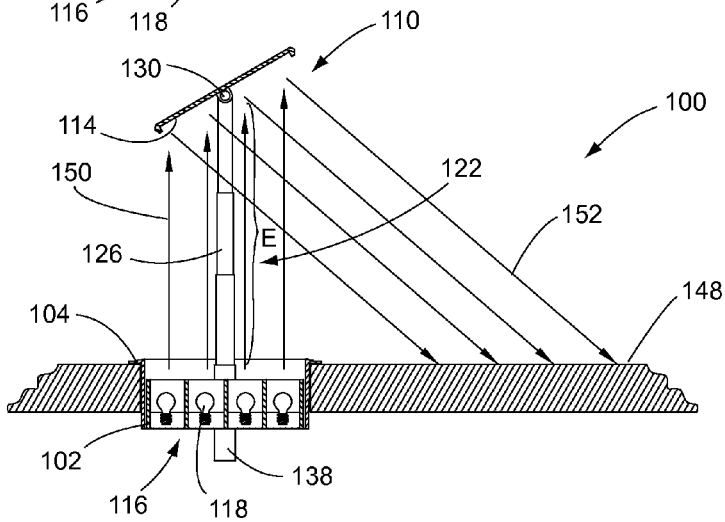
FIG. 7 is a side, sectional view of the flush mount mirror light, in a view substantially similar to FIG. 5, but showing the mirror in an orientation substantially corresponding to the orientation in FIG. 2.

FIG. 7 illustrates the telescoping tubes 126 at what may be characterized as a maximum height E. With the mirror 114 at the angular orientation shown in FIG. 7, the light rays 152 impinge outwardly to a distance intermediate the outermost rays 152 shown in FIG. 5, and the outermost light rays 152 shown in FIG. 6.

Figure 8:
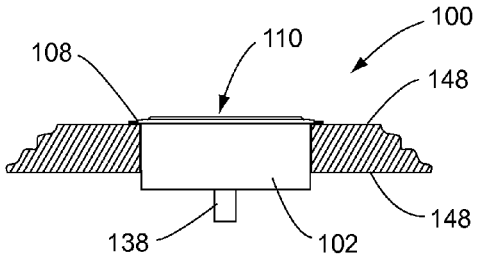
FIG. 8 is a side view of the flush mount mirror light in a fully retracted or recessed position.

FIG. 8 illustrates a side, sectional view of the light assembly 100 in a fully retracted position. The element shown in FIG. 8 as element 138 can be in the form of a power cord, or merely the bottom of the telescoping tubes 126. It should also be noted that although not specifically shown in the drawings, a switch or similar enabling means can be included within the light assembly 100 for enabling the light array 116, as well as disabling the light array 116.

Figure 9:
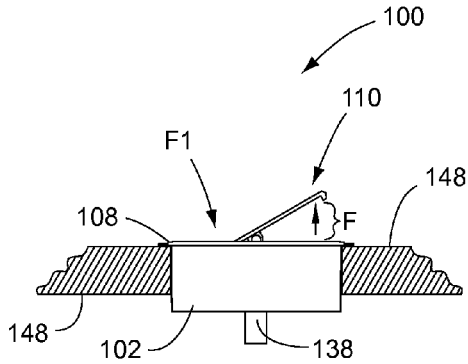
FIG. 9 is a side view of the flush mount mirror light shown in FIG. 8, but with the mirror being partially open.
Figure 10:
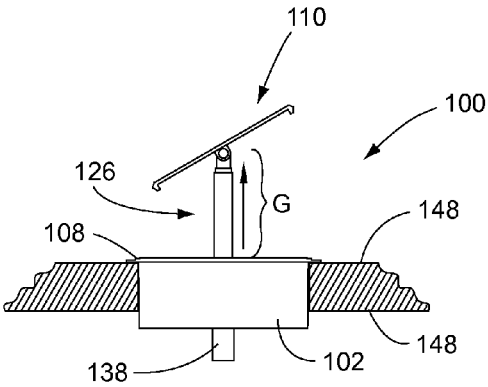
FIG. 10 is a side view of the flush mount mirror light shown in FIG. 9, and showing the mirror and the telescoping supports in a further extended position.
Figure 11:
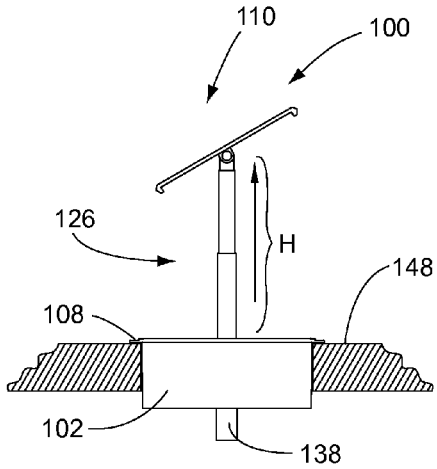
FIG. 11 is a side view of the flush mount mirror light shown in FIG. 10, but showing the mirror and the telescoping supports in a still further extended position.
Figure 12:
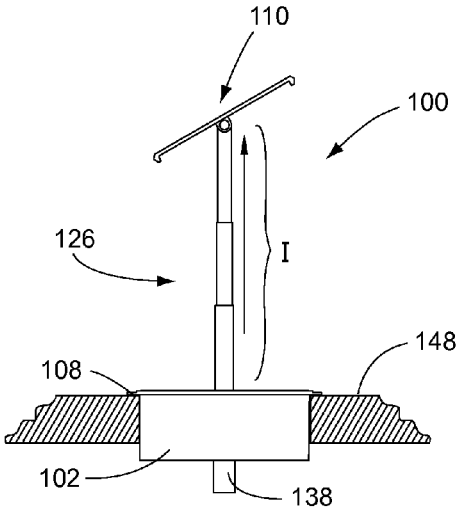
FIG. 12 is a side view of the flush mount mirror light shown in FIG. 11, but showing the telescoping supports and the mirror in a fully extended position.

FIG. 9 illustrates the concept that to initially open the light assembly 100, downward forces (illustrated as forces F1 in FIG. 9) can be exerted on one side of the mirror cover 112. These forces will cause the mirror assembly 110 to rotate about the rotational hinges 132, so that one side of the mirror assembly 110 moves upwardly above the flush surface of the work surface 148. With this movement, the user has sufficient room between the upwardly angled edge of the mirror assembly 110 and the housing 102 so as to grasp the mirror assembly 110 and direct forces upwardly to raise the mirror assembly 110. FIG. 9 illustrates an initial position, with the telescoping tubes 126 at a height F. FIG. 10 illustrates further upward movement of the light assembly 100, showing the telescoping tubes 126 at a height G. Still further movement will cause the telescoping tubes to raise to a height H, as shown in FIG. 11. A maximum height for the telescoping tubes 126 and the three telescoping sections 128 is shown as height I in FIG. 12.

Figure 13:
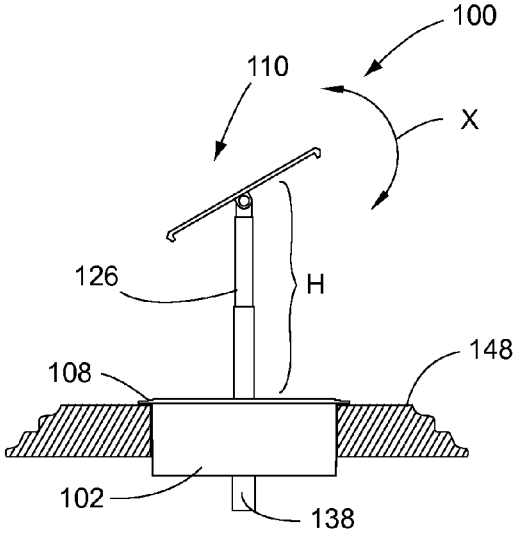
FIG. 13 is a side view of the flush mount mirror light in at least a partially extended position, and showing the mirror in a first angular orientation.
Figure 14:
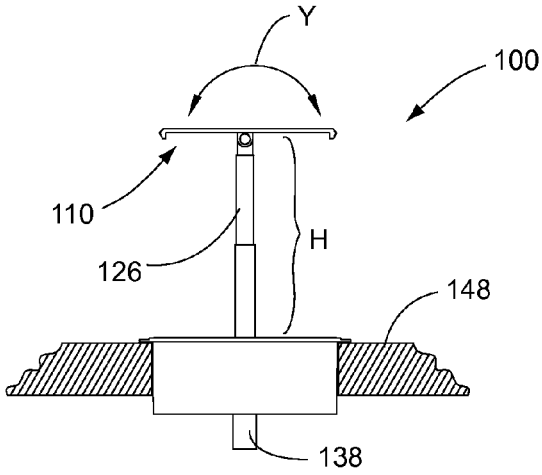
FIG. 14 is a side view of the flush mount mirror light shown in FIG. 13, and showing the mirror in a substantially horizontal, planer configuration.
Figure 15:
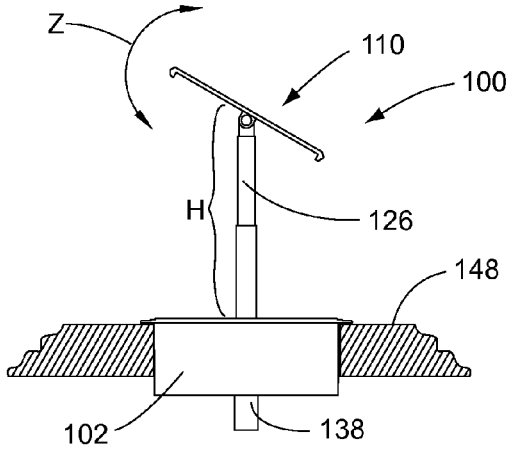
FIG. 15 is a side view of the flush mount mirror light shown in FIG. 14, and showing the mirror in a further orientation, which could be characterized as substantially opposing the orientation of the mirror in FIG. 13.

FIGS. 13-15 illustrate various angular orientations which may be provided for the mirror assembly 110. For example, FIG. 13 illustrates the telescoping tubes 126 at a height H, and the mirror assembly at an angle X. Correspondingly, FIG. 14 illustrates the telescoping tubes 126 at the same height H, while the mirror assembly 110 is at an angle Y. Specifically, angle Y is shown as actually a zero angle relative to a horizontal plane of the work surface 148. Still further, FIG. 15 illustrates the telescoping tubes 126 again at height H, but with the mirror assembly 110 at an angular orientation corresponding to angle Z. Angle Z could be characterized as a mirror angle of angle X shown in FIG. 13.

It will be apparent to those skilled in the pertinent arts that other embodiments of retractable light assemblies in accordance with the invention can be designed. That is, the principles of retractable light assemblies in accordance with the invention are not limited to the specific embodiment described herein. Accordingly, it will be apparent to those skilled in the art that modifications and other variations of the above-described illustrative embodiment of the invention may be effected without departing from the spirit and scope of the novel concepts of the invention.

The invention claimed is:

1. A mirror light assembly adapted to be mounted in a desktop or other work surface, said light assembly comprising:

a housing;

a mirror assembly having a reflective mirror;

a light array mounted within said housing and comprising a plurality of lights positioned so as to generate light in an upward direction;

a tube assembly comprising at least a pair of tubes, each of said tubes being capable of extension between a closed tube position and a first extended tube position, and each of said tubes is a telescoping tube having a plurality of elongated positions;

said mirror assembly is coupled to said tube assembly so that when said tube assembly is in said closed tube position, said mirror assembly is in a closed mirror position, and when said tube assembly is in said first extended tube position, said mirror assembly is positioned at first extended mirror position;

when said mirror assembly is in said first extended mirror position, said reflective mirror reflects said light generated from said light array onto at least a portion of said desktop or other work surface; and when said tube assembly is in said closed tube position, said mirror assembly is positioned substantially flush with a top of said desktop or other work surface.

2. A mirror light assembly in accordance with claim 1, characterized in that said plurality of lights are individually arranged within light compartments within said housing.

3. A mirror light assembly in accordance with claim 1, characterized in that said mirror assembly is coupled to both tubes of said pair of tubes.

4. A mirror light assembly in accordance with claim 3, characterized in that each of said pair of tubes is positionable at a second extended tube position which is different than said first extended tube position.

5. A mirror assembly in accordance with claim 3, characterized in that said mirror assembly is pivotably coupled to said tube assembly so as to be positionable among a plurality of angular orientations.

6. A mirror light assembly in accordance with claim 5, characterized in that said tube assembly and said mirror assembly are structured so that by adjustment of said angular orientations of said mirror assembly, the positioning of a surface area of said desktop or work surface illuminated by said reflected light, as well as the size of said illuminated surface area, can correspondingly be adjusted.

7. A mirror light assembly in accordance with claim 1, characterized in that said tubes are constructed so that a user can exert relatively minimal forces upwardly so as to extend the tubes to a desired height, and said tubes maintain their then current positions, absent any external forces applied to said tubes.

8. A mirror light assembly in accordance with claim 7, characterized in that when said user wishes to retract said mirror assembly, said user can exert downwardly directed forces either on said tubes themselves or, alternatively, on said mirror assembly.

9. A mirror light assembly in accordance with claim 8, characterized in that said mirror light assembly comprises a hinge system for providing manual rotation or pivot of said mirror assembly by said user, so as to adjust an angle of said reflective mirror relative to said light array and said desktop or work surface.

10. A mirror light assembly in accordance with claim 9, characterized in that said hinge system comprises a pair of rotational hinges located at top portions of said telescoping tubes, and also located at opposing sides of said mirror assembly, said hinge system and said rotational hinges forming coupling or pivot points between said telescoping tubes and said mirror assembly.

11. A mirror light assembly in accordance with claim 10, characterized in that:

each of said rotational hinges comprises a pair of lug set pairs fixedly mounted to sides of said mirror assembly adjacent a face of said mirror;

fixedly mounted to uppermost telescoping sections of said telescoping tubes are a pair of laterally extending nubs, sized and configured so as to extend through apertures of each lug of said lug set pairs; and said lugs of said lug set pairs, said apertures and said laterally extending nubs are sized and configured so as to provide for angular rotation of said mirror assembly relative to said telescoping tube pair through exertion of relatively minimal manual forces applied to said mirror assembly.

12. A mirror light assembly in accordance with claim 11, characterized in that the sizing and configuration of said lug set pairs, said nubs and said apertures cause said mirror assembly to maintain an angular configuration at which said mirror assembly is set by said user, absent the application of additional manual forces.

* * * * *